US010138703B2

(12) United States Patent
Skinnes

(10) Patent No.: US 10,138,703 B2
(45) Date of Patent: Nov. 27, 2018

(54) DRAINAGE FOR A TELESCOPE SECTION OF A LANDING STRING

(71) Applicant: WellPartner AS, Tananger (NO)

(72) Inventor: Kenneth Skinnes, Stavanger (NO)

(73) Assignee: WellPartner AS, Tananger (NO)

( * ) Notice: Subject to any disclaimer, the term of this patent is extended or adjusted under 35 U.S.C. 154(b) by 47 days.

(21) Appl. No.: 15/519,906

(22) PCT Filed: Oct. 20, 2015

(86) PCT No.: PCT/NO2015/050193

§ 371 (c)(1),
(2) Date: Apr. 18, 2017

(87) PCT Pub. No.: WO2016/064277

PCT Pub. Date: Apr. 28, 2016

(65) Prior Publication Data

US 2017/0247976 A1 Aug. 31, 2017

(30) Foreign Application Priority Data

Oct. 23, 2014 (NO) ..... 20141265

(51) Int. Cl.
*E21B 17/07* (2006.01)
*E21B 17/20* (2006.01)
(Continued)

(52) U.S. Cl.
CPC ..... *E21B 33/143* (2013.01); *E21B 17/07* (2013.01); *E21B 19/002* (2013.01); *E21B 33/043* (2013.01)

(58) Field of Classification Search
None
See application file for complete search history.

(56) References Cited

U.S. PATENT DOCUMENTS 5,443,122 A 8/1995 Brisco
5,660,241 A * 8/1997 Leising ..... E21B 17/07 175/321
(Continued)

FOREIGN PATENT DOCUMENTS

| | | |
|---|---|---|
| NO | 328917 | 6/2010 |
| WO | 2006/012186 | 2/2006 |
| WO | 2009/142509 | 11/2009 |

OTHER PUBLICATIONS

Norwegian Search Report, Norwegian Application No. 20141265, date of report May 22, 2015.
(Continued)

*Primary Examiner* — Matthew R Buck
*Assistant Examiner* — Douglas S Wood
(74) *Attorney, Agent, or Firm* — Andrus Intellectual Property Law, LLP

(57) ABSTRACT

A drainage device is for a tubular, telescopic pipe-landing unit having a through pipe bore partially formed of a center pipe extending from an upper end portion of an outer pipe-landing section and with a free end in through an upper end portion of an inner pipe-landing section, which is axially movable in the outer pipe-landing section. The center pipe has a fluid-communication opening arranged for pressure equalization between the pipe bore and an annulus between the center pipe and the outer pipe-landing section. The annulus has a drain passage arranged to be opened by the axial movement of the inner pipe-landing section into the outer pipe-landing section away from an extended, operative position, in which an abutment portion on the upper end portion of the inner pipe-landing section is resting sealingly against a seat portion on a lower end portion of the outer pipe-landing section.

20 Claims, 3 Drawing Sheets

(51) Int. Cl.

| | |
|---|---|
| ***E21B 33/14*** | (2006.01) |
| ***E21B 33/043*** | (2006.01) |
| ***E21B 19/00*** | (2006.01) |

(56) References Cited

U.S. PATENT DOCUMENTS

| | | | | |
|---|---|---|---|---|
| 6,779,599 | B2 * | 8/2004 | Mullins | E21B 19/16 166/177.4 |
| 9,435,164 | B2 * | 9/2016 | Fenwick | E21B 23/00 |
| 2004/0221997 | A1 | 11/2004 | Giroux et al. | |
| 2013/0157767 | A1 | 6/2013 | Slack | |
| 2016/0153248 | A1 * | 6/2016 | Richards | E21B 17/06 166/335 |

OTHER PUBLICATIONS

International Search Report, PCT/NO2015/050193, dated Jan. 5, 2016.
Written Opinion and Response, PCT/NO2015/050193, dated Jan. 5, 2016.

* cited by examiner

DRAINAGE FOR A TELESCOPE SECTION OF A LANDING STRING

FIELD

The invention relates to drainage device for a tubular, telescopic pipe-landing unit provided with a through pipe bore partially formed of a centre pipe extending from an upper end portion of an outer pipe-landing section and with a free end in through an upper end portion of an inner pipe-landing section, which is axially movable in the outer pipe-landing section, the centre pipe being provided with at least one fluid-communication opening arranged for pressure equalization between the pipe bore and an annulus defined between the centre pipe and the outer pipe-landing section.

BACKGROUND

When casing is being run into a wellbore and the annulus outside the casing is subsequently being cemented, the casing is connected to a cementing head for cement to be fed into the annulus. When subsea structures are being cased, a landing-pipe string extends between the upper end portion of the casing and the installation from which the drilling takes place, typically a platform projecting up above the sea surface. With the technical solutions of today, when the operations are taking place from a floating vessel, the casing must be hung off with a safe distance to the planned setting depth, the distance depending on the expected heave motions of the drilling vessel. The normal distance is typically 15-25 meters. The cementing head must then be connected to the landing-pipe string at an even greater height above the rotary table on the drilling floor, and this is a time-consuming and hazardous operation, which takes place partially with personnel hanging in belts from the derrick. The cementing head will often be hanging from the derrick for some considerable time, waiting to be connected, and a situation with hanging objects above the drilling floor is not desirable from a safety point of view.

When the casing remains hanging above the setting depth for a long time, there is always a risk that there may be a blocking of the casing against the borehole wall, so that further movement to the planned setting depth is impeded.

The drawbacks of this technique is partially remedied by using a tubular, telescopic pipe-landing unit as it is described in the applicant's own NO-patent 328917. It has turned out that the use of this pipe-landing unit has resulted in a substantial simplification of the operations connected to the landing of borehole installations from a floating surface installation, but great challenges still attach to the maintenance of such pipe-landing units when they are used in connection with cementing operations. During the pumping of cement through the landing string, the annulus between an inner pipe-landing section and an outer pipe-landing section will become filled at least partially with cement, and after the operation has been carried out, the prior-art telescopic pipe-landing unit must therefore be thoroughly cleaned, an operation, which is time-consuming and costly. With poor cleaning, cement residues will set in the annulus, which may ruin the telescoping function of the unit or the seal systems of the unit.

SUMMARY

The invention has for its object to remedy or reduce at least one of the drawbacks of the prior art or at least provide a useful alternative to the prior art.

The object is achieved through features, which are specified in the description below and in the claims that follow.

The invention relates to drainage for a tubular, telescopic pipe-landing unit for landing a device in a borehole, from a floating installation, the tubular, telescopic pipe-landing unit forming a section of the landing-pipe string. The pipe-landing unit may be adapted for carrying the weight of the landing-pipe string and the borehole device. The pipe-landing unit exhibits a central pipe bore for conveying fluids, plugs and the like which are to be carried down into the borehole. The pipe-landing unit may be rotationally rigid and be arranged to transmit a torque to the landing-pipe string. The pipe-landing unit is particularly adapted for setting and cementing casing, but other devices, which are to be put on a foundation in the borehole or at a wellhead can be handled by means of a device according to the invention as well.

A centre pipe (also called a "stinger" by a person skilled in the art) is fixed to and extends from an upper end portion of an outer pipe-landing section into an upper portion of an inner pipe-landing section, which can be moved axially in the outer pipe-landing section. Between the centre pipe and the outer pipe-landing section, an annulus has been formed, which, when the pipe-landing unit is fully extended, is in pressure-equalizing fluid communication with the internal bore of the centre pipe forming a portion of the central pipe bore through the pipe-landing unit. In use, the annulus is thereby filled with fluid, and when cement is being pumped through the pipe-landing string, some cement may enter the annulus. This amount of cement must be removed when the operation is finished, so that the cement will not set in the annulus.

In its upper portion, the inner pipe-landing section is provided with an external, annular abutment portion, which is arranged to rest in a pressure-sealing manner against an internal seat portion in a lower portion of the outer pipe-landing section.

Said fluid communication between the central pipe bore and the annulus is provided by at least one opening being arranged in the immediate vicinity of the limit of the annulus against the upper portion of the inner pipe-landing section when this is fully extended. When the pipe-landing unit is being retracted and the abutment portion of the inner pipe-landing section is lifted from its internal seat portion in the outer pipe-landing section, said openings are closed, blocking fluid communication between the centre bore and the annulus. At the same time, drain passages are opened between the annulus and the surroundings of the pipe-landing unit. The drain openings may be formed as axial passages in the abutment portion of the inner pipe-landing section or axial passages between the abutment portion and the internal wall of the outer pipe-landing section and also passages through the seat portion or between the seat portion and the external jacket surface of the inner pipe-landing section.

The at least one opening between the centre bore and the annulus has an axial extent, which is so large that it is closed only after a drain connection has been established between the annulus and the surroundings of the pipe-landing unit through said drain passages. As the pipe-landing unit is being retracted, the extent of the annulus is reduced as fluid is being drained from the annulus to the surroundings. Thereby cement residues, if any, are flushed out of the annulus together with the fluid that the annulus contained before the cementing operation started.

The invention is defined by the independent claim. The dependent claims define advantageous embodiments of the invention.

The invention relates more specifically to a drainage device for a tubular, telescopic pipe-landing unit provided with a through pipe bore partially formed of a centre pipe, which extends from an upper end portion of an outer pipe-landing section and with a free end in through an upper end portion of an inner pipe-landing section, which is axially movable in the outer pipe-landing section, the centre pipe being provided with at least one fluid-communication opening arranged for pressure equalization between the pipe bore and an annulus defined between the centre pipe and the outer pipe-landing section, characterized by the annulus being provided with a drain passage which is arranged to be opened by the axial movement of the inner pipe-landing section into the outer pipe-landing section away from an extended, operative position in which an abutment portion of the upper end portion of the inner pipe-landing section is resting sealingly against a seat portion on a lower end portion of the outer pipe-landing section.

A portion of the drain passage may be formed as one or more clearances between the lower end portion of the outer pipe-landing section and a jacket surface of the inner pipe-landing section.

A portion of the drain passage may be formed as one or more bores between the seat portion on the lower end portion of the outer pipe-landing section and the periphery of said end portion.

The upper end portion of the inner pipe-landing section may form a piston, which has a tight fit against the internal wall surface of the outer pipe-landing section, and a portion of the drain passage may be formed as one or more axial bores through a shoulder portion on the abutment portion.

The seat portion may form a substantially cylindrical recess, which is arranged to accommodate a substantial part of the abutment portion, and several seat seals may be spaced apart axially on the seat portion and/or abutment portion.

The upper end portion of the inner pipe-landing section may be provided with at least one centre-pipe seal, which abuts against the jacket surface of the centre pipe.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
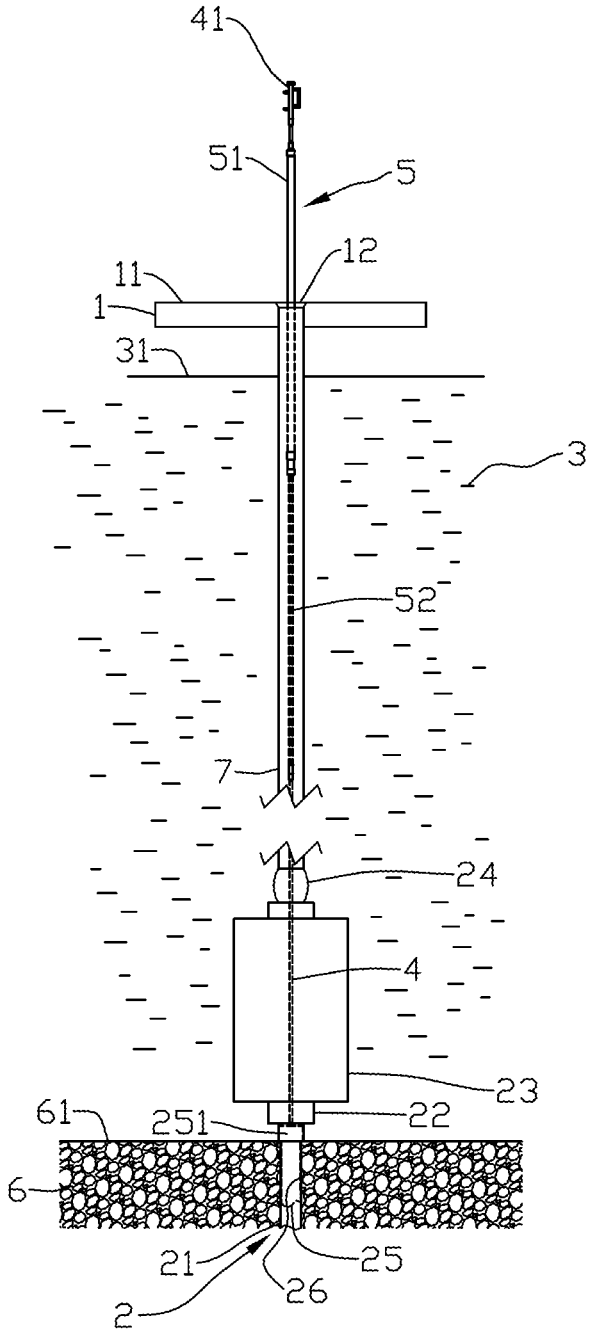
FIG. 1 shows a schematic side view of a borehole during the running of a casing in the borehole, the casing having been lowered through a riser extending between a wellhead and a drilling floor of a floating installation, the casing having been hung off in the drilling floor via a landing-pipe string including a pipe-landing unit which is extended here and is partially taking weight off the landing string, and a cementing head having been connected to the pipe-landing string.

Reference is first made to FIG. 1, in which the reference numeral 1 indicates a floating installation, for example a drilling rig, provided with a drilling floor 11 and a rotary table 12. The installation 1 is floating on the surface 31 of a water mass 3 over an underground 6 where a well 2 extends down from a seabed 61 into the underground 6. The well 2 is formed in a borehole 21, in which, from a wellhead 22, casing 25 extends down the borehole 21, defining a borehole annulus 26 towards the underground 6 in a manner known per se. The casing 25 is hung off in a hanger 251 in the wellhead 22. On the wellhead 22, a blowout preventer 23 is arranged, and from a flexible coupling 24 on the blowout preventer 23, a riser 7 extends up to the installation 1 on the sea surface 31. The riser 2 is hung off in the floating installation 1 in a manner known per se (not shown).

A landing-pipe string 4 extends from the installation 1 down into the well 2 and is arranged, in a manner known per se, to carry cement from the installation 1 down into the well 2 in order to at least partially fill the annulus 26 between the casing 25 and the underground 6 to fix the casing 25 to the underground 6, possibly to fill an annulus, not shown, between the casing 25 and a further casing, not shown, of another diameter. The cement is carried into the landing-pipe string 4 through a cementing head 41 above the drilling floor 11. The landing-pipe string 4 is preferable adapted for hanging off in the rotary table 11.

The landing-pipe string 4 is provided with a telescopic pipe-landing unit 5 in a manner known per se. In FIG. 1, this is arranged in the upper end of the landing-pipe sting 4 but it may possibly be arranged closer to the wellhead 22.

It is obvious to a person skilled in the art that the landing-pipe string 4 may also be used for riserless operations, that is to say without there being a riser 7 extending between the installation 1 on the surface 31 and the well 2.

Figure 2:
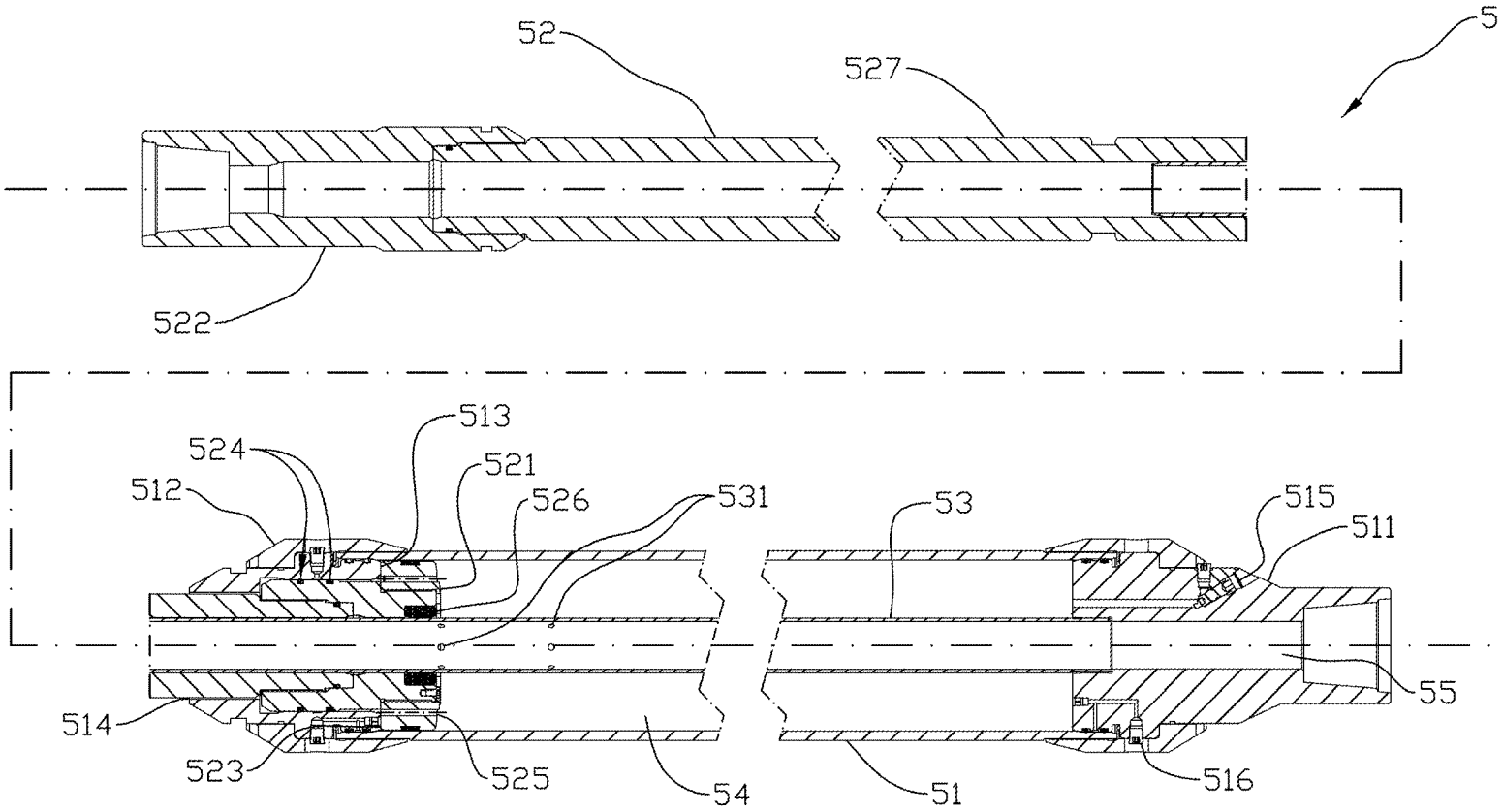
FIG. 2 shows an axial section through a pipe-landing unit according to the invention fully extended, there being fluid communication between a central bore and an annulus in the pipe-landing unit.
Figure 3:
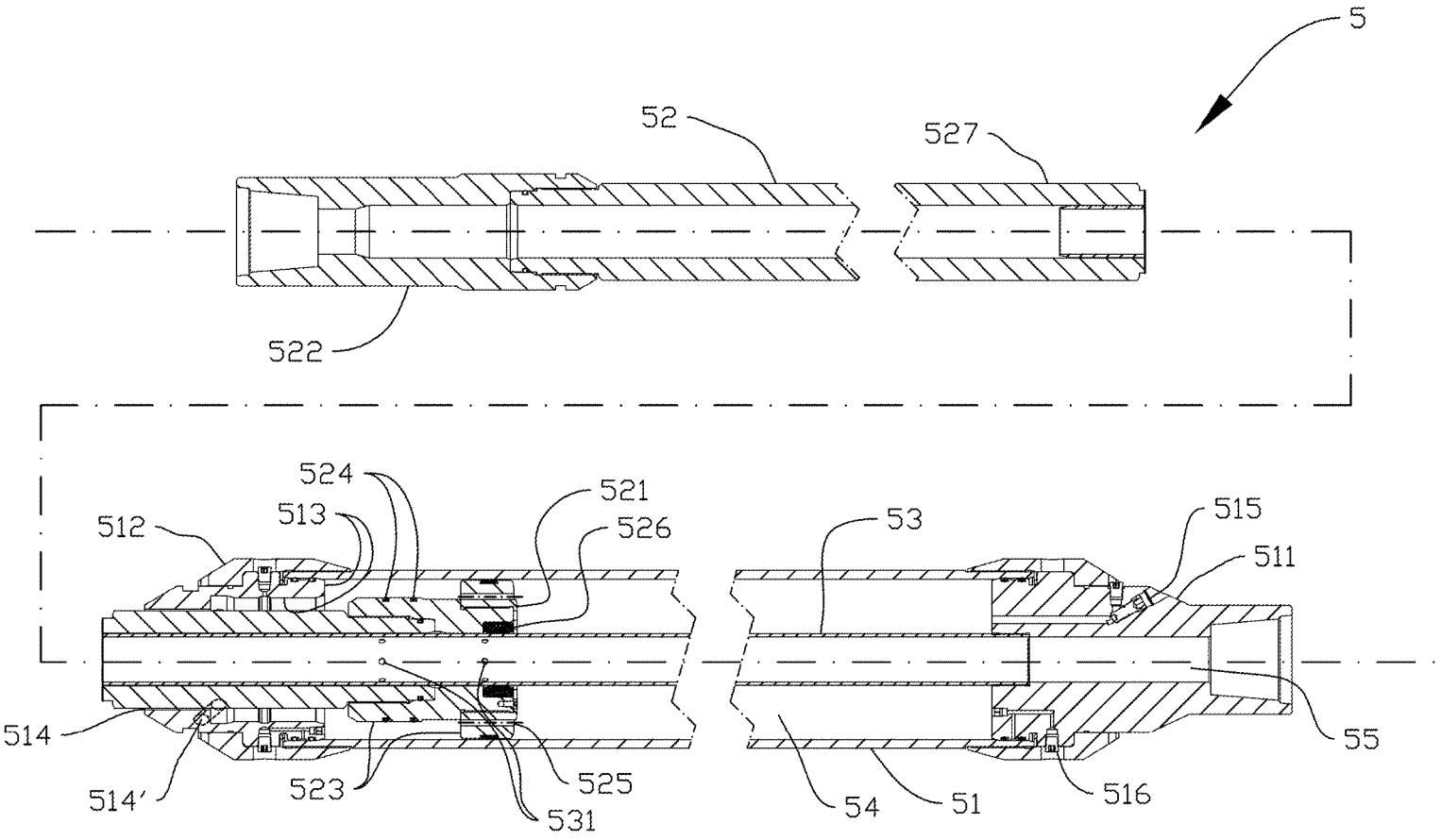
FIG. 3 shows an axial section through the pipe-landing unit partially retracted, the fluid communication between the central bore and the annulus being closed, and drain passages between the annulus and the surroundings of the pipe-landing unit having been opened.

Reference is now made especially to FIGS. 2 and 3, in which the telescopic pipe-landing unit 5 is shown in greater detail. An outer pipe-landing section 51 is connected in an upper end portion 511 to a centre pipe 53 which extends through the outer pipe-landing section 51 and past a lower end portion 512 of the outer pipe-landing section 51 and into an inner pipe-landing section 52, wherein a centre-pipe seal 526 arranged in an upper end portion 521 of the inner pipe-landing section 52 seals between the periphery of the centre pipe 53 and the inner pipe-landing section 52, preventing fluid from entering. The centre pipe 53 is thin-walled to provide a portion of a smooth pipe bore 55 extending through the pipe-landing unit 5 with as little obstruction as possible for plugs or the like that are to be passed through the landing-pipe string 4.

The inner pipe-landing section 52 may be moved into the outer pipe-landing section 51 from an extended position in which an abutment portion 523 arranged in the upper end portion 521 of the inner pipe-landing section 52 is resting against a seat portion 513 arranged in the lower end portion 512 of the outer pipe-landing section 51. Seat seals 524 fit tightly between the pipe-landing sections 51, 52 in the extended position of the pipe-landing unit 5.

An annulus 54 is defined by the outer pipe-landing section 51, its upper end portion 511, the centre pipe 53 and the upper end portion 521 of the inner pipe-landing section 52. Several fluid-communication openings 531 are arranged in the centre pipe 53 so that fluid communication is provided between the bore of the centre pipe 53 and the annulus 54 when the pipe-landing unit 5 is in its extended position. The fluid pressure inside and outside the centre pipe 53 will thereby be equalized when fluid under pressure is flowing through the pipe-landing unit 5 in the extended, operative position thereof. The centre pipe 53 may thereby be formed with a relatively thin pipe wall.

The upper end portion 521 of the inner pipe-landing section 52 and the lower end portion 512 of the outer pipe-landing section 51 include a drain passage for the evacuation of the annulus 54 when the pipe-landing unit 5 is being retracted and the volume of the annulus 54 is being reduced. In the exemplary embodiment shown, said drain passage is formed as axial bores 525 in the abutment portion 523 of the inner pipe-landing section 52 and as a radial clearance 514 between the lower end portion 512 of the outer pipe-landing section 51 and a jacket surface 527 of the inner pipe-landing section 52. As long as the pipe-landing unit 5 is fully extended, the seat seals 524 will seal the drain passage 514, 525, but when the pipe-landing unit 5 is retracted so that the seat seals 524 does not fit tightly between the end sections 512, 521, fluid may flow through the axial bores 525 and out through the clearance 514 between the end portions 512, 521. At the same time, the fluid communication openings 531 have been closed by having been moved past the centre-pipe seal 526. Thereby fluid may not enter the annulus 54 from the centre pipe 53. This is seen best in FIG. 3.

In FIG. 3, a drain passage portion 514' is also shown as an alternative or a supplement to said radial clearance 514, there being one or more bores 514' arranged between the seat portion 513 and the periphery of the end portion 512.

The fluid-communication openings 531 have so large an extent in the axial extent of the pipe-landing unit 5 that they close completely only as the drain passage 514, 514', 525 has opened. As the seat seals 524 have an abutment area of a certain axial extent, the clearance 514 is kept tight over a certain axial distance of movement of the inner pipe-landing section 52, and the fluid-communication openings 531 may therefore have a corresponding axial extent. In the exemplary embodiment shown, two rows of fluid-communication openings 531 are arranged on the periphery of the centre pipe 53, spaced apart axially and evenly distributed on the periphery of the centre pipe 53. Alternatively, the fluid-communication openings 531 may, for example, be provided as oblong slots extending in the axial direction of the centre pipe 53.

A lower end portion 522 on the inner pipe-landing section 52 and the upper end portion 511 of the outer pipe-landing section 51 are adapted for connection to the landing-pipe string 4.

When the landing-pipe string 4 with the pipe-landing unit 5 is lowered to the well 2, the annulus 54 will fill with a fluid, typically water from the surrounding water mass 3, through the fluid-communication openings 531 by the very fact of the pipe-landing unit 5 usually becoming extended to its extended position because of the weight of the underlying, connected landing-pipe string 4 and/or other elements that are connected to the landing-pipe string 4. The annulus 54 may possibly, in the retracted position of the pipe-landing unit 5, be filled by fluid entering through the drain passage 514, 514', 525. The initial filling of the annulus 54 may possibly take place before the pipe-landing unit 5 is lowered into the water mass, through a suitable, closable fill opening 515 in the upper end portion 511 of the outer pipe-landing section 51. Air, possibly other gases, present may be evacuated through a closable evacuation opening 516 in the upper end portion 511 of the outer pipe-landing section 51.

When a fluid is pumped through the landing-pipe string 4, the pipe-landing unit 5 is extended and is tightly closed towards the surroundings. The fluid pressure in the centre pipe 53 and in the annulus 54 is equalized through the fluid-communication openings 531. Some pumping fluid, for example cement, may thereby enter the annulus 54 through the fluid-communication openings 531, and there is therefore a need to remove this pumping fluid from the annulus 54 when the operation is finished, so that there is no risk of the pipe-landing unit 5 becoming ruined by the pumping fluid. The annulus 54 is emptied when the pipe-landing unit 5 is retracted, fluid initially exiting through the fluid-communication openings 531. When the inner pipe-landing section 52 has been moved so far in that the drain passage 514, 514', 525 has been opened, the fluid also exits there, and after the fluid-communication openings 531 have been closed by having passed the centre-pipe seal 526, the fluid will flow from the annulus only through the drain passage 514, 514', 525. As the fluid is exiting the annulus 54, any residues of cement or other harmful fluids are flushed out of the annulus 54 as well. Cement or other undesired fluids present in the landing-pipe string 4 and thereby also in the centre bore of the pipe-landing unit 5, is/are removed by means known per se, for example by flushing with a fluid suitable therefor, often with cleaning plugs being sent through the landing-pipe string 4 as well. The desired effect has been achieved: the telescopic pipe-landing unit 5 is free of harmful fluids. If required, the flushing of the annulus 54 can be repeated, the annulus 54, after a flushing fluid has been pumped into the landing-pipe string 4, becoming filled, when the pipe-landing unit 5 is being extended, by said flushing fluid entering through the fluid-communication opening 531 and being usable for repeated flushing.

It should be noted that the above-mentioned embodiment illustrates the invention, but does not limit it, and persons skilled in the art may construct many alternative embodiments without departing from the scope of the dependent claims.

In the claims, reference numbers in brackets are not to be regarded as restrictive. The use of the verb "to comprise" and its various forms, does not exclude the presence of elements or steps, which are not mentioned in the claims. The indefinite article "a" or "an" before an element does not exclude the presence of several such elements.

The invention claimed is:

1. A drainage device for a tubular, telescopic pipe-landing unit provided with a through pipe bore partially formed of a center pipe extending from an upper end portion of an outer pipe-landing section and with a free end in through an upper end portion of an inner pipe-landing section, which is axially movable in the outer pipe-landing section, the center pipe being provided with at least one fluid-communication opening arranged for pressure equalization between the pipe bore and an annulus defined between the center pipe and the outer pipe-landing section, wherein the annulus is provided with a drain passage which is arranged to be opened by the axial movement of the inner pipe-landing section into the outer pipe-landing section away from an extended, operative position, in which an abutment portion of the upper end portion of the inner pipe-landing section is resting sealingly against a seat portion on a lower end portion of the outer pipe-landing section.

2. The drainage according to claim 1, wherein a portion of the drain passage is formed as one or more clearances between the lower end portion of the outer pipe-landing section and a jacket surface of the inner pipe-landing section.

3. The drainage according to claim 1, wherein a portion of the drain passage is formed as one or more bores between the seat portion on the lower end portion of the outer pipe-landing section and a periphery of the lower end portion.

4. The drainage according to claim 1, wherein the upper end portion of the inner pipe-landing section forms a piston, which fits tightly against an internal wall surface of the outer pipe-landing section, and a portion of the drain passage is formed as one or more axial bores through a collar on the abutment portion.

5. The drainage according to claim 1, wherein the seat portion forms a substantially cylindrical recess, which is arranged to accommodate a substantial part of the abutment portion, and several seat seals are arranged in an axially spaced-apart manner on at least one of the seat portion and the abutment portion.

6. The drainage according to claim 1, wherein the upper end portion of the inner pipe-landing section is provided with at least one center-pipe seal abutting against a jacket surface of the center pipe.

7. The drainage device according to claim 1, wherein the center pipe is fixed to the upper end portion of the outer pipe-landing section.

8. The drainage device according to claim 1, wherein the inner pipe-landing section is axially movable along the center pipe.

9. A drainage device for a tubular, telescopic pipe-landing unit provided with a through pipe bore partially formed of a center pipe extending from an upper end portion of an outer pipe-landing section and with a free end in through an upper end portion of an inner pipe-landing section, which is axially movable in the outer pipe-landing section, the center pipe being formed therethrough with at least one fluid-communication opening arranged for transfer of fluid and for pressure equalization in an extended, operative position between the pipe bore and an annulus defined between the center pipe and the outer pipe-landing section, wherein the annulus is provided with a drain passage which is configured to drain fluid from the annulus to the surroundings of the pipe-landing unit and is arranged to be opened by the axial movement of the inner pipe-landing section into the outer pipe-landing section to a retracted, operative position away from the extended, operative position, in which an abutment portion of the upper end portion of the inner pipe-landing section is resting sealingly against a seat portion on a lower end portion of the outer pipe-landing section.

10. The drainage device according to claim 9, wherein the upper end portion of the outer pipe-landing section is connected to the center pipe.

11. The drainage device according to claim 9, wherein the annulus is further defined by the upper end portion of the outer pipe-landing section and the upper end portion of the inner pipe-landing section.

12. The drainage device according to claim 9, wherein the pipe-landing unit is configured such that, in the retracted, operative position, the at least one fluid communication opening is arranged to be closed to prevent transfer of fluid between the center pipe and the annulus while fluid is drained from the annulus through the drain passage.

13. The drainage device according to drain 7, wherein, the pipe-landing unit is configured, in the retracted, operative position, such that a fluid volume of the annulus is reduced relative to a fluid volume of the annulus in the extended, operative position as fluid is drained from the annulus.

14. The drainage device according to claim 9, wherein the fluid includes water and cement.

15. The drainage device according to claim 9, wherein the upper end portion of the outer pipe-landing section includes a closable fill opening configured to enable filling the annulus with fluid.

16. The drainage device according to claim 9, wherein the upper end portion of the outer pipe-landing section includes a closable evacuation opening configured to enable evacuation of gases from the annulus.

17. The drainage device according to claim 9, wherein the drain passage is operably configured to prevent setting of the fluid in the annulus.

18. A drainage device for a tubular, telescopic pipe-landing unit provided with a through pipe bore partially formed of a center pipe extending from an upper end portion of an outer pipe-landing section and with a free end in through an upper end portion of an inner pipe-landing section, which is axially movable in the outer pipe-landing section, the center pipe being provided with at least one fluid-communication opening arranged for pressure equalization between the pipe bore and an annulus defined between the center pipe and the outer pipe-landing section, wherein the annulus is provided with a drain passage which is arranged to be opened by the axial movement of the inner pipe-landing section into the outer pipe-landing section away from an extended, operative position, in which an abutment portion of the upper end portion of the inner pipe-landing section is resting sealingly against a seat portion on a lower end portion of the outer pipe-landing section, wherein the upper end portion of the inner pipe-landing section forms a piston, which fits tightly against an internal wall surface of the outer pipe-landing section, and a portion of the drain passage is formed as one or more axial bores through a collar on the abutment portion.

19. A drainage device for a tubular, telescopic pipe-landing unit provided with a through pipe bore partially formed of a center pipe extending from an upper end portion of an outer pipe-landing section and with a free end in through an upper end portion of an inner pipe-landing section, which is axially movable in the outer pipe-landing section, the center pipe being formed therethrough with at least one fluid-communication opening arranged for transfer of fluid and for pressure equalization in an extended, operative position between the pipe bore and an annulus defined between the center pipe and the outer pipe-landing section, wherein the annulus is provided with a drain passage which is configured to drain fluid from the annulus to the surroundings of the pipe-landing unit and is arranged to be opened by the axial movement of the inner pipe-landing section into the outer pipe-landing section to a retracted, operative position away from the extended, operative position, in which an abutment portion of the upper end portion of the inner pipe-landing section is resting sealingly against a seat portion on a lower end portion of the outer pipe-landing section, wherein, the pipe-landing unit is configured, in the retracted, operative position, such that a fluid volume of the annulus is reduced relative to a fluid volume of the annulus in the extended, operative position as fluid is drained from the annulus.

20. A drainage device for a tubular, telescopic pipe-landing unit provided with a through pipe bore partially formed of a center pipe extending from an upper end portion of an outer pipe-landing section and with a free end in through an upper end portion of an inner pipe-landing section, which is axially movable in the outer pipe-landing section, the center pipe being formed therethrough with at least one fluid-communication opening arranged for transfer of fluid and for pressure equalization in an extended, operative position between the pipe bore and an annulus defined between the center pipe and the outer pipe-landing section, wherein the annulus is provided with a drain passage which is configured to drain fluid from the annulus to the surroundings of the pipe-landing unit and is arranged to be opened by the axial movement of the inner pipe-landing section into the outer pipe-landing section to a retracted, operative position away from the extended, operative position, in which an abutment portion of the upper end portion of the inner pipe-landing section is resting sealingly against a seat portion on a lower end portion of the outer pipe-landing section, wherein the fluid includes water and cement.

* * * * *